US009152074B1

(12) United States Patent
Ohshima

(10) Patent No.: US 9,152,074 B1
(45) Date of Patent: Oct. 6, 2015

(54) IMAGE FORMING APPARATUS AND CONTROL METHOD OF IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masami Ohshima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/303,698

(22) Filed: Jun. 13, 2014

(51) Int. Cl.
*B41J 2/385* (2006.01)
*G03G 15/043* (2006.01)

(52) U.S. Cl.
CPC ..... *G03G 15/043* (2013.01); *G03G 2215/0424* (2013.01)

(58) Field of Classification Search
USPC ..... 347/132, 134, 137, 138, 241–245, 252
See application file for complete search history.

(56) References Cited

FOREIGN PATENT DOCUMENTS

JP 04-267276 9/1992

*Primary Examiner* — Kristal Feggins
(74) *Attorney, Agent, or Firm* — Amin, Turocy & Watson, LLP

(57) ABSTRACT

In accordance with one embodiment, an image forming apparatus comprises a plurality of light-emitting elements arranged in a line, an image forming section and an exposure control section. The image forming section develops, with developing agent, a latent image formed on a photoconductive drum through the light from the light-emitting elements which emit light according to printing data. The exposure control section controls the operations of the plurality of light-emitting elements according to shifted printing data obtained by shifting the printing data in a case where the number of printings based on the same printing data is more than one.

6 Claims, 4 Drawing Sheets

IMAGE FORMING APPARATUS AND CONTROL METHOD OF IMAGE FORMING APPARATUS

FIELD

Embodiments described herein relate to an image forming apparatus and a control method of the image forming apparatus.

BACKGROUND

There is a digital multi-functional peripheral (MFP) provided with an image forming apparatus which forms a latent image on a photoconductive drum with an exposure section consisting of a plurality of light-emitting elements such as LEDs or organic ELs arranged in a line, and carries out printing on a medium such as paper. As to such an image forming apparatus, in a case where the number of printings based on the same printing data is more than one, the light-emission frequency of some light-emitting elements within the plurality of light-emitting elements arranged in a line is high, which leads to a problem that the life of part of the light-emitting elements becomes shorter.

DETAILED DESCRIPTION

In accordance with one embodiment, an image forming apparatus comprises a plurality of light-emitting elements arranged in a line, an image forming section and an exposure control section. The image forming section develops, with developing agent, a latent image formed on a photoconductive drum through the light from the light-emitting elements which emit light according to printing data. The exposure control section controls the operations of the plurality of light-emitting elements according to shifted printing data obtained by shifting the printing data in a case where the number of printings based on the same printing data is more than one.

Hereinafter, the image forming apparatus and a control method of the image forming apparatus according to the embodiment are described in detail with reference to the accompanying drawings.

Figure 1:
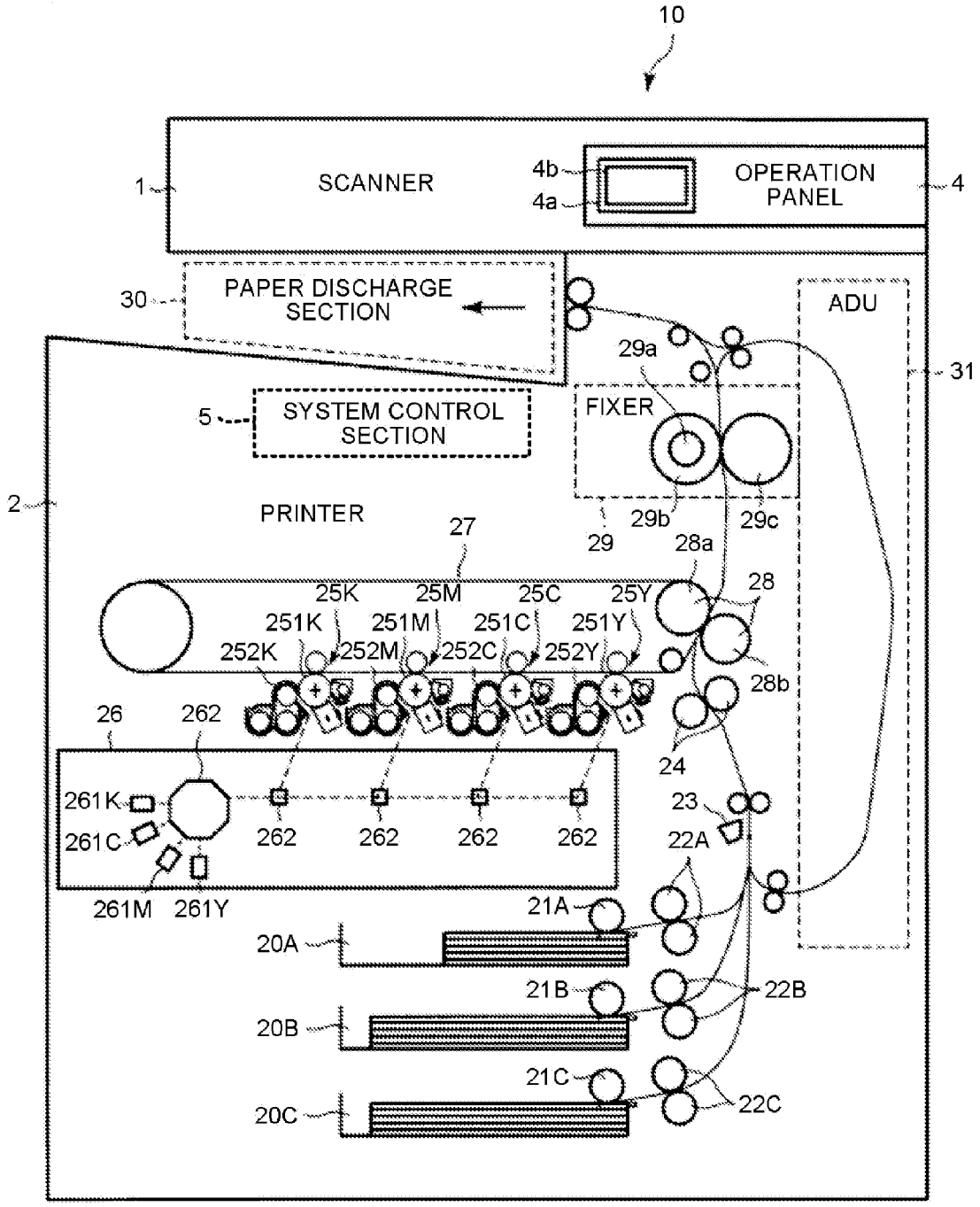
FIG. 1 is a diagram illustrating an example of the constitution of a digital multi-functional peripheral according to one embodiment.

FIG. 1 is a cross-sectional view schematically illustrating an example of the constitution of a digital multi-functional peripheral according to the embodiment. The digital multi-functional peripheral (MFP: Multi-Functional Peripheral) according to the present embodiment functions as an image erasing apparatus and an image forming apparatus. As shown in FIG. 1, the digital multi-functional peripheral comprises a scanner 1, a printer 2, an operation panel 4 and a system control section 5.

The scanner 1 reads an image on a document and converts it into image data. The scanner 1 is composed of a CCD line sensor and the like for converting, for example, the image on the reading surface of the document into image data. The scanner 1 may be a device which scans the document placed on a document table glass or a device which reads the image of a document conveyed by an auto document feeder (ADF). Further, the scanner 1 has a function (document detection function) of detecting the size of the document. The scanner 1 is arranged at, for example, the upper portion of the main body of the digital multi-functional peripheral. The scanner 1 is controlled by a system control section 5. The scanner 1 output the image data of the document to the system control section 5.

The printer 2 forms an image on paper serving as an image formed medium. The printer 2 serving as an image forming apparatus has a color printing function of printing a color image on paper and a monochrome printing function of printing a monochrome (for example, black) image on paper. For example, the printer 2 is an electrophotographic type image forming apparatus. The printer 2 forms a color image using toner of a plurality of colors (for example, three colors of yellow (Y), cyan (C) and magenta (M)). Further, the printer 2 forms a monochrome image using monochrome (for example, black) toner.

In the example of constitution shown in FIG. 1, the printer 2 includes paper feed cassettes 20 (20A, 20B and 20C) which serve as paper feed sections for feeding paper on which an image is to be printed. Further, the printer 2 may also include a manual feeding tray and the like serving as a paper feed section. For example, each paper feed cassette 20A, 20B and 20C is arranged at the lower portion of the main body of the digital multi-functional peripheral in a detachable manner. These paper feed cassettes 20A, 20B and 20C respectively store paper of a set category (for example, size and quality).

The setting information such as the information relating to the paper stored in each paper feed cassette is stored in a non-volatile memory (for example, a NVM 54 described later). The printer 2 selects the paper feed cassette in which the paper to be used in printing processing is stored according to the setting information. The printer 2 prints an image on the paper fed from the selected paper feed cassette. In addition, in a case where the printer 2 includes a manual feeding tray, like each paper feed cassette, the setting information relating to the paper stored in the manual feeding tray may also be stored in the non-volatile memory.

Each paper feed cassette 20A, 20B and 20C is provided with a pickup roller 21A, 21B and 21C, respectively. The pickup rollers 21A, 21B and 21C pick up paper one by one from each paper feed cassette 20A, 20B and 20C. The pickup rollers 21A, 21B and 21C feed the picked up paper to a conveyance path (conveyance section) 22 provided with a plurality of conveyance rollers and the like. The number of the paper feed cassettes serving as paper feed sections and the number of the pickup rollers are not limited to three. For example, the number of the paper feed cassettes and the number of the pickup rollers may be one or two, or more than four. Further, the paper feed section is not limited to the cassette, and it may also be a manual feeding tray.

The conveyance section 22 conveys paper in the printer 2. The conveyance section 22 conveys the paper fed by the pickup rollers 21A, 21B and 21C to a register roller 24. The register roller 24 conveys the paper to a transfer position at the timing of transferring an image to the paper from the intermediate transfer belt 27.

Image forming sections 25 (25Y, 25M, 25C and 25K), an exposure section 26, an intermediate transfer belt 27 and a transfer section 28 function as an image forming module for forming an image. The image forming sections 25 (25Y, 25M, 25C and 25K) form an image which is to be transferred to the paper.

Each image forming section 25 is provided with a photoconductive drum 251 and a developer 252, respectively. The photoconductive drums 251 (251Y, 251M, 251C and 251K) serve as image carriers on which a latent image is formed with laser light. The developers 252 (252Y, 252M, 252C and 252K) serve as developing sections which hold toner (developing agent) of different colors, respectively, and develop the latent image formed on the photoconductive drum. The image forming section 25Y is provided with a photoconductive drum 251Y and a developer 252Y which holds yellow toner. The image forming section 25M is provided with a photoconductive drum 251M and a developer 252M which holds magenta toner. The image forming section 25C is provided with a photoconductive drum 251C and a developer 252C which holds cyan toner. The image forming section 25K is provided with a photoconductive drum 251K and a developer 252K which holds black toner.

In the example of constitution shown in FIG. 1, the image forming section 25Y forms an image with yellow toner. The image forming section 25M forms an image with magenta toner. The image forming section 25C forms an image with cyan toner. The image forming section 25K forms an image with black toner. Each image forming section 25 (25Y, 25M, 25C and 25K) superimposes and transfers the image of each color to the intermediate transfer belt 27. In this way, a color image is formed on the intermediate transfer belt 27.

The exposure section 26 forms an electrostatic latent image on the photoconductive drum 251 (image carrier) of each image forming section 25 (25Y, 25M, 25C and 25K) through laser light. The exposure section 26 is provided with light emitting sections 261 (261Y, 261M, 261C and 261K) including LEDs, organic ELs or other light-emitting elements capable of outputting laser light which are arranged in a plurality of lines, and an optical system 262 for reflecting the laser light from the light emitting section 261 to the photoconductive drum 251. In addition, the photoconductive drum 251 is a cylindrical drum the shaft of which is along the depth direction of FIG. 1. Each light emitting section 261 includes a plurality of light-emitting elements which are arranged in a line in the depth direction of FIG. 1 to emit laser light to the photoconductive drum 251. In addition, the "in a line" mentioned above indicates, for example, that a plurality of light-emitting elements of each light emitting section 261 are arranged in a line. Further, the "in a line" mentioned above indicates, for example, a state in which a plurality of light-emitting elements of each light emitting section 261 are arranged side by side in a row.

The exposure section 26 outputs laser light from the light-emitting element of the light emitting section 261 according to the image data (printing data) for printing. Moreover, the exposure section 26 radiates the output laser light to the photoconductive drum 251 through the optical system 262 such as a polygon mirror. The output laser light from the exposure section 26 forms an electrostatic latent image on the surface of each photoconductive drum 251.

In addition, the optical systems 262 of the exposure section 26 are arranged in such a manner that the laser light from the light emitting section 261Y is reflected to the photoconductive drum 251Y of the image forming section 25Y, the laser light from the light emitting section 261M is reflected to the photoconductive drum 251M of the image forming section 25M, the laser light from the light emitting section 261C is reflected to the photoconductive drum 251C of the image forming section 25C, the laser light from the light emitting section 261K is reflected to the photoconductive drum 251K of the image forming section 25K, respectively.

The exposure section 26 controls the laser light of each light-emitting element of the light emitting section 261 according to the printing data input from the system control section 5. The electrostatic latent image formed on each photoconductive drum 251 is equivalent to the image developed with the toner of each color. For example, the exposure section 26 controls the power of the laser light of each light-emitting element of the light emitting section 261 according to the printing data input from the system control section 5. Further, the exposure section 26 controls, for example, the modulation quantity of pulse width for controlling the light-emitting of each of the light-emitting element of the light emitting section 261 according to the printing data.

Each image forming section 25 (25Y, 25M, 25C and 25K) develops the electrostatic latent image formed on the photoconductive drums 251 thereof with the toner of each color. Each image forming section 25 (25Y, 25M, 25C and 25K) forms a toner image serving as a visible image on the photoconductive drum 251. The intermediate transfer belt 27 is an intermediate transfer body. Each image forming section 25 (25Y, 25M, 25C and 25K) transfers (primarily transfer) the toner image formed on the photoconductive drum 251 to the intermediate transfer belt 27. Each image forming section 25 (25Y, 25M, 25C and 25K) applies a transfer bias to the toner image at a primary transfer position. Each image forming section 25 (25Y, 25M, 25C and 25K) controls the transfer bias through transfer current. The toner image on each photoconductive drum 251 is transferred to the intermediate transfer belt 27 through the transfer bias at the primary transfer position thereof. The system control section 5 controls the transfer current which is used by each image forming section in the primary transfer processing.

Further, each image forming section 25Y, 25M, 25C and 25K has a sensor such as a potential sensor, a concentration sensor and the like, respectively. The potential sensor is a sensor for detecting the surface potential of the photoconductive drum 251. In each image forming section 25Y, 25M, 25C and 25K, a charging charger charges the surface of the photoconductive drum 251 before it is exposed by the exposure section 26. The system control section 5 can change the charging condition based on the charging charger. The potential sensor detects the surface potential of the photoconductive drum 251 the surface of which is charged by the charging charger. The concentration sensor detects the concentration of the toner image transferred to the intermediate transfer belt 27. Further, the concentration sensor may also be a sensor detecting the concentration of the toner image formed on the photoconductive drum 251.

For example, in a case of forming a monochrome image, the image forming section 25K transfers (primarily transfer) the toner image (visible image) developed with the black (monochrome) toner to the intermediate transfer belt 27. As a result, the intermediate transfer belt 27 holds a monochrome image formed with the black (monochrome) toner.

Further, in a case of forming a color image, each image forming section 25Y, 25M, 25C and 25K superimposes and transfers (primarily transfer) the toner image (visible image) developed with the toner of each color (yellow, magenta, cyan and black) to the intermediate transfer belt 27. As a result, the intermediate transfer belt 27 holds a color image obtained by overlapping the toner image of each color.

The transfer section 28 transfers the toner image on the intermediate transfer belt 27 to the paper at a secondary transfer position. The secondary transfer position is a position where the toner image on the intermediate transfer belt 27 is transferred to the paper. The secondary transfer position is a position where a support roller 28*a* and secondary transfer roller 28*b* are opposed. The transfer section 28 applies a transfer bias which is controlled through transfer current at the secondary transfer position. The transfer section 28 transfers the toner image (color erasable toner image or general toner image) on the intermediate transfer belt 27 to the paper through the transfer bias. The system control section 5 controls the transfer current which is used in a secondary transfer processing. For example, the system control section 5 may respectively control the transfer current used in a case of transferring the color erasable toner image and the transfer current used in a case of transferring the general toner image.

A fixer 29 has a function of fixing the toner on the paper. For example, in the embodiment, the fixer 29 fixes the toner image on the paper through heat applied to the paper. However, the fixer 29 is not limited to a fixer which fixes an image by heating as long as the fixer 29 can fix an image on paper.

The fixer 29 has a constitution of applying heat to paper for carrying out a fixing processing. In the constitution example shown in FIG. 1, the fixer 29 consists of a heating roller 29*b* in which a heating section 29*a* is arranged and a pressing roller 29*c* which contacts with the fixing belt heated by the heating roller 29*b* in pressure. The heating section 29*a* may be a temperature controllable heater. For example, the heating section 29*a* may be a heater consisting of a heater lamp such as a halogen lamp and the like, or an induction heating (IH) heater. Further, the heating section 29*a* may also consist of a plurality of heaters.

For example, in a case of carrying out the fixing processing of fixing the toner image on the paper, the system control section 5 controls the fixer 29 to the fixing temperature. The fixer 29 controlled to the fixing temperature presses and heats the paper to which the toner image is transferred by the transfer section 28 at the fixing temperature. In this way, the fixer 29 fixes the toner image on the paper. Further, the fixer 29 conveys the paper subjected to fixing processing to a paper discharge section 30 or an automatic double-sided unit (ADU) 31.

In a case of discharging the paper subjected to the fixing processing by the fixer 29, the paper is conveyed to the paper discharge section 30. Further, in a case of forming an image on the back side of the paper subjected to the fixing processing by the fixer 29, the paper is temporarily conveyed towards the paper discharge section 30, and then switched back and conveyed to the ADU 31. In this case, the ADU 31 feeds the paper which is inverted through the switch-back to the register roller 24 again.

The operation panel 4 is a user interface. The operation panel 4 comprises a display section 4*a* which includes various buttons and a touch panel 4*b*. The system control section 5 controls the content to be displayed on the display section 4*a* of the operation panel 4. Further, the operation panel 4 outputs information input through the touch panel 4*b* or the buttons of the display section 4*a* to the system control section 5. A user designates an operation mode, or inputs information such as setting information and the like in the operation panel 4. For example, the user designates the specific paper feed cassette (paper feed section) to be the black (monochrome) dedicated cassette. Herein, the black (monochrome) dedicated cassette is the cassette (paper feed section) which is merely used in the monochrome (black) printing and is forbidden to be used in the color printing.

Next, the constitution of the control system of the digital multi-functional peripheral is described.

Figure 2:
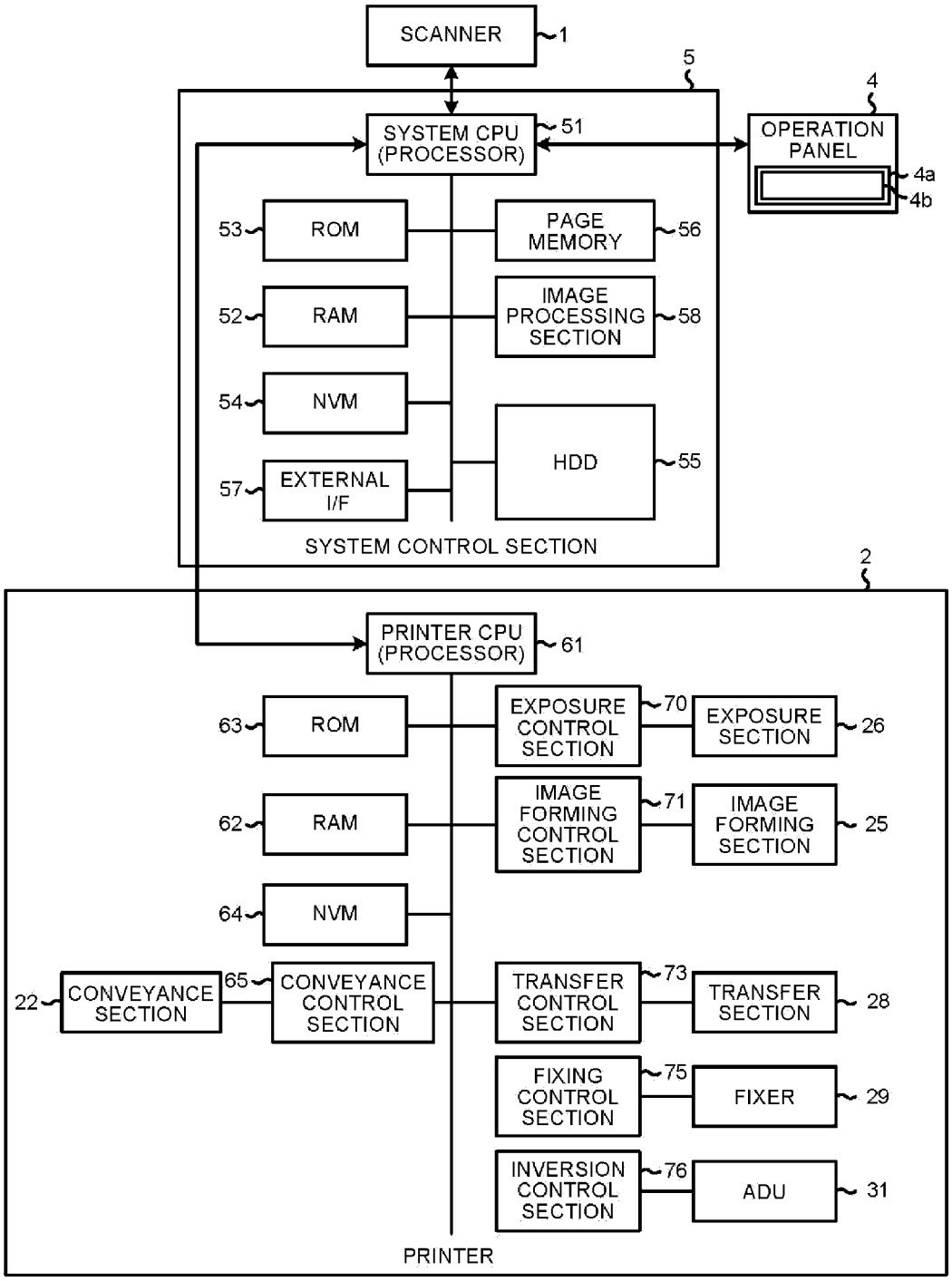
FIG. 2 is a diagram illustrating an example of a control system of the digital multi-functional peripheral according to the embodiment.

FIG. 2 is a block diagram schematically illustrating an example of the constitution of the control system in the system control section 5 and the printer 2 of the digital multi-functional peripheral.

In the constitution example shown in FIG. 2, the system control section 5 comprises a system CPU (processor) 51, a RAM 52, a ROM 53, a non-volatile memory (NVM) 54, a HDD 55, a page memory 56, an external interface (I/F) 57 and an image processing section 58.

The system CPU 51 uniformly controls the whole digital multi-functional peripheral and each section. The system CPU 51, which is a processor realizing processing by executing a program, is connected with each section of the system control section 5 through a system bus line. In addition to each section of the system control section 5, the system CPU 51 is also connected with the scanner 1, the printer 2, the operation panel 4 and the like through the system bus line. The system CPU 51 outputs an operation instruction to each section and acquires various kinds of information from each section through a two-way communication with the scanner 1, the printer 2 and the operation panel 4. Further, the system CPU 51 inputs information indicating detection signals of various sensors arranged in each section of the system control section 5, an operation state and the like.

The RAM 52 consists of a volatile memory. The RAM 52 functions as a working memory or a buffer memory. The ROM 53 is an unrewritable non-volatile memory for storing a program, control data and the like. The system CPU 51 realizes various processing by executing the program stored in the ROM 53 (or the non-volatile memory 54 or the HDD 55) while using the RAM 52. For example, the system CPU 51 functions as a printing execution module and a printing forbidden module by executing the program.

The non-volatile memory (NVM) 54 is a rewritable non-volatile memory which stores the control program executed by the system CPU 51 and the control data. Further, NVM 54 stores various kinds of setting information, processing conditions and the like. For example, the NVM 54 stores the setting information for each paper feed cassette (paper feed section). The setting information for the paper feed cassette includes, for example, flag information indicating whether or not the cassette is the black dedicated cassette.

The hard disk drive (HDD) 55 is a high-capacity storage device. The HDD 55 stores the image data, various kinds of operation history information and the like. Further, the HDD 55 may also store the control program, the control data and the like, or the setting information, the processing condition and the like.

The page memory 56 is a memory for expanding the image data to be processed. For example, in case of carrying out copy processing, the page memory 56 stores the image data which is read by the scanner 1 and is subjected to the image processing for scanning. The system CPU 51 carries out the image processing for printing on the image data stored in the page memory 56, and outputs the printing data to the printer 2. Further, the system CPU 51 store the image data stored in the page memory 56 in the HDD 55, and send the image data to an external device through the external interface 57.

The external interface (I/F) 57 is an interface for communicating with the external device. For example, the external interface 57 receives printing data corresponding to a print request from the external device. The external interface 57 may be an interface for carrying out data notification with the external device; for example, the external interface 57 may be an interface locally connected with the external device, or a network interface for communicating through a network.

The image processing section 58 carries out image processing on the image data read by the scanner 1, and converts the data to the printing data. The image processing section 58 has a function of an image processing section of a scanner system for carrying out an image processing on the image data read by the scanner 1, a compression and expansion section for carrying out compression or expansion processing on the image data, and an image processing section of a printer system for generating the printing data for printing to be printed by the printer 2 on a paper. For example, as the image processing section of a scanner system, the image processing section 58 has functions such as shading correction processing, gradation conversion processing, interline correction processing and the like.

Next, an example of the constitution of the control system in the printer 2 is described.

In the constitution example shown in FIG. 2, the printer 2 comprises, as the constitution of the control system, a printer CPU (processor) 61, a RAM 62, a ROM 63, a non-volatile memory (NVM) 64, a conveyance control section 65, an exposure control section 70, an image forming control section 71, a transfer control section 73, a fixing control section 75, an inversion control section 76 and the like.

The printer CPU 61 controls the whole printer 2. The printer CPU 61, which is a processor realizing processing by executing a program, is connected with each section of the printer 2 through a system bus line and the like. The printer CPU 61 outputs, in response to the operation instruction from the system CPU 51, an operation instruction to each section of the printer 2, and notifies various kinds of information acquired from each section to the system CPU 51.

The RAM 62 consists of a volatile memory. The RAM 62 functions as a working memory or a buffer memory. The ROM is an unrewritable non-volatile memory for storing program, control data and the like. The printer CPU 61 realizes various processing by executing the program stored in the ROM 63 (or the non-volatile memory 64) while using the RAM 62.

The non-volatile memory (NVM) 64 is a rewritable non-volatile memory which stores, for example, the control program executed by the printer CPU 61 and the control data. Further, the non-volatile memory 64 store the setting information, processing conditions and the like.

The conveyance control section 65 controls the paper conveyance in the printer 2 and the driving of the pickup roller 21 and the conveyance section 22. The conveyance control section 65 controls the driving of the conveyance rollers serving as the conveyance section 22 in the printer 2 in response to the operation instruction from the printer CPU 61. For example, the printer CPU 61 instructs, in response to an instruction of starting image erasing processing or image forming processing from the system control section 5, the conveyance control section 65 to start to feed a paper with the pickup roller 21 and the conveyance section 22.

The exposure control section 70 controls the exposure processing carried out by the exposure section 26. The exposure control section 70 executes an exposure processing of enabling each light-emitting element of the light emitting section 261 of the exposure section 26 to emit light and forming an electrostatic latent image on the photoconductive drum 251 of each image forming section 25Y, 25M, 25C and 25K in response to the operation instruction from the printer CPU 61. For example, the exposure control section 70 controls, in response to the printing data instructed by the printer CPU 61, the exposure section 26 so that each light-emitting element of the light emitting section 261 of the exposure section 26 irradiates each photoconductive drum 251 with laser light.

The image forming control section 71 controls the driving of each image forming section 25Y, 25M, 25C and 25K. The image forming control section 71 develops, in response to the operation instruction from the printer CPU 61, the electrostatic latent image formed on the photoconductive drum 251 of each image forming section 25Y, 25M, 25C and 25K with toner of each color. The transfer control section 73 controls the driving of the transfer section 28 and the transfer current and the like. The transfer control section 73 transfers, in response to the operation instruction from the printer CPU 61, the toner image transferred to the intermediate transfer belt 27 to the paper using the transfer section 28.

The fixing control section 75 controls the driving of the fixer 29. The fixing control section 75 drives the heating roller 29*b* and the pressing roller 29*c* in response to the operation instruction from the printer CPU 61. Further, the fixing control section 75 controls the surface temperature of the heating roller 29*b* to a desired temperature by controlling the heating section 29*a*. The fixing control section 75 controls the surface temperature of the heating roller 29*b* to a temperature (fixing temperature) designated by the printer CPU 61.

The inversion control section 76 controls the driving of the ADU 31. The inversion control section 76 feeds, in response to the operation instruction from the printer CPU 61, the paper passing through the fixer 29 to an image reading position of the scanner 23 again using the ADU 31. For example, in a case of forming an image on the back side of the paper subjected to the fixing processing (in a case of duplex printing), the inversion control section 76 carries out a driving control such that the paper subjected to the fixing processing is temporarily conveyed towards the paper discharge section 30, and then switched back to be conveyed to the ADU 31. The ADU 31 feeds the paper switched back by the paper discharge section 30 to the register roller 24 again. In this way, the paper is fed to the register roller 24 again in an inverted state.

Figure 3:
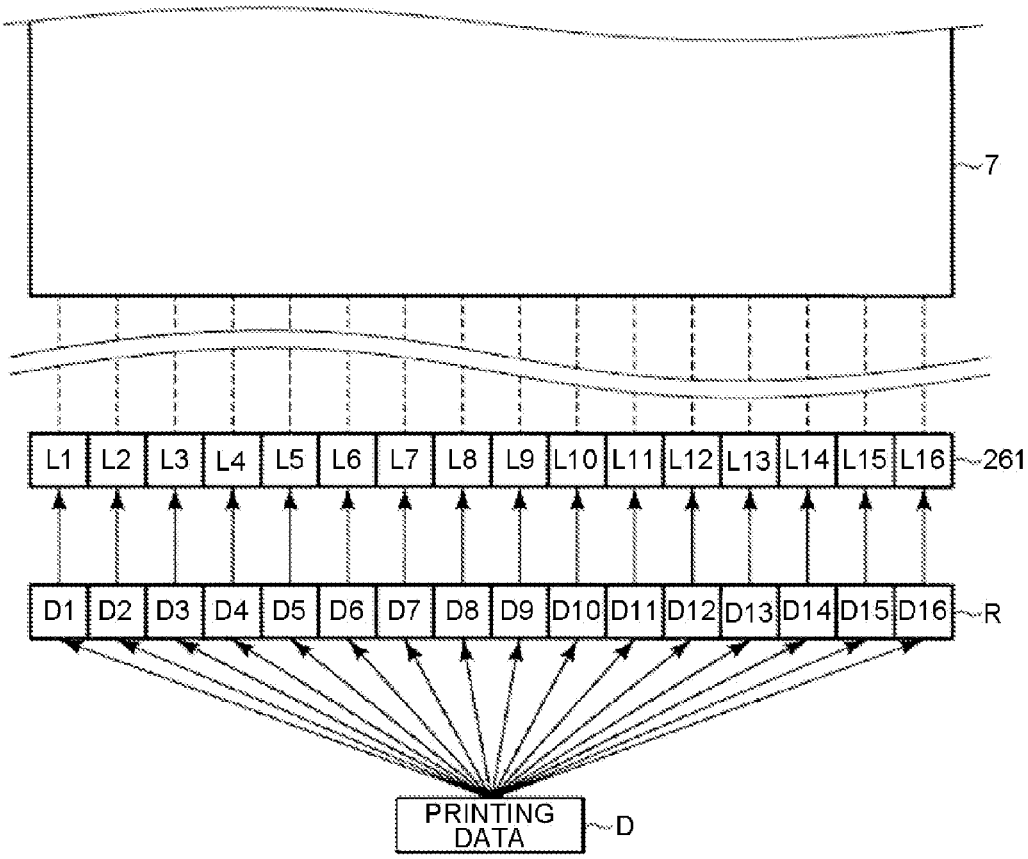
FIG. 3 is a diagram illustrating the operations of an exposure control section of the digital multi-functional peripheral according to the embodiment.

FIG. 3 is a diagram illustrating an example of the operations of the exposure control section 70 and the exposure section 26.

As stated above, the light emitting section 261 of the exposure section 26 comprises a plurality of light-emitting elements L (L1, L2 . . . L16) arranged in a line. The plurality of light-emitting elements L (L1, L2 . . . L16) are arranged in such a manner that each of the light-emitting elements L (L1, L2 . . . L16) corresponds to a given position on a paper sheet 7 serving as a printing medium, respectively. That is, in a case of carrying out printing at a certain position on the paper sheet 7, generally, the laser light from the same light-emitting element L is emitted to the photoconductive drum 251.

In a case where the printing data is received from the printer CPU 61, the exposure control section 70 can input the printing data to each light-emitting element L of the light emitting section 261 to enable each light-emitting element L to emit light.

The printing data D supplied from the printer CPU 61 includes a set (page set) of one or more pages. The exposure control section 70 is provided with an image memory for storing the printing data D temporarily. The image memory is, for example, a RAM or a non-volatile memory. The exposure control section 70 can store the printing data D received form the printer CPU 61 in the image memory.

Further, the printing data D includes the information for instructing the number of printings of the page set (number of printings). The exposure control section 70 controls the exposure section 26 so that the page sets corresponding to the number of printings are printed.

The printing data D for one page is the image data in which the data of each dot is arranged in a matrix form. The printing data D is formed by lining up, in a plurality of lines, the data for one line arranged in one row. The exposure control section 70 can input the printing data to each light-emitting element L for each line to form a latent image for one line on the photoconductive drum 251. As shown in FIG. 3, the exposure control section 70 can carry out a control to sequentially input the printing data for one line of the printing data to each light-emitting element L of the light emitting section 261 so that each light-emitting element L outputs laser light sequentially.

The photoconductive drum 251 rotates at a given speed based on the control of the image forming control section 71. The exposure control section 70 can form a latent image line by line on the rotating photoconductive drum 251 to form a latent image corresponding to the printing data on the photoconductive drum 251.

For example, the printing data for one line includes a plurality of data "D1" "D2" . . . "D15" and "D16". The data "D1" "D2" . . . "D15" and "D16" corresponds to one dot on the paper sheet 7, respectively.

In addition, the exposure control section 70 comprises, for example, a register R including a plurality of storage areas corresponding to each light-emitting element L of the light emitting section 261. The exposure control section 70 reads the printing data D from the image memory line by line, and stores the read printing data D for one line in each storage area of the register R mentioned above. Each light-emitting element L of the light emitting section 261 emits light according to the data stored in the corresponding storage area on the register R. That is, each storage area on the register R corresponds to one dot on the paper sheet 7, respectively.

Figure 4:
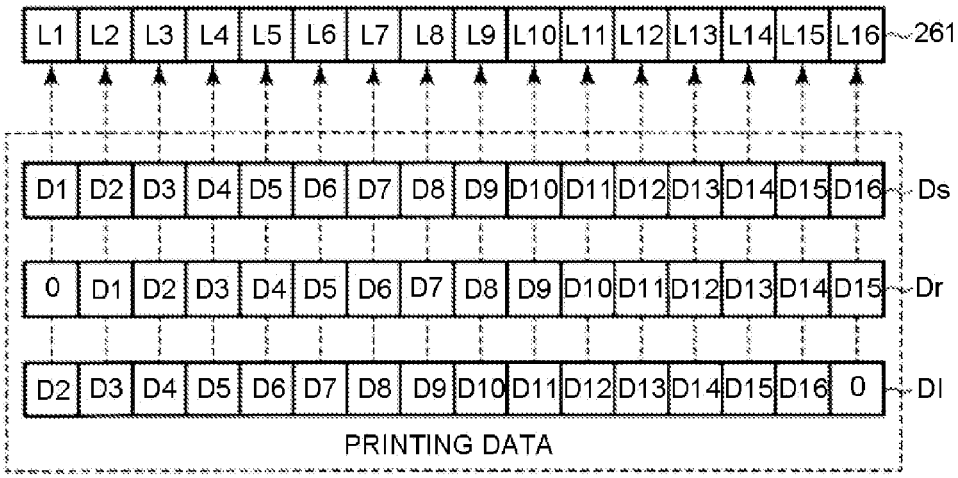
FIG. 4 is a diagram illustrating the operations of the exposure control section of the digital multi-functional peripheral according to the embodiment.

FIG. 4 is a diagram illustrating an example of the control carried out by the exposure control section 70.

For example, in a case where the number of printings of a certain printing data is more than one, the exposure control section 70 shifts the position of the printing data for each page set.

The exposure control section 70 sets the input printing data as the standard printing data Ds. Further, the exposure control section 70 shifts the data of each dot of the standard printing data Ds one dot at a time towards the right direction to generate shifted printing data Dr. Moreover, the exposure control section 70 shifts the data of each dot of the standard printing data Ds one dot at a time towards the left direction to generate shifted printing data D1.

That is, the standard printing data Ds is the printing data which is not shifted. The shifted printing data Dr is the data generated by shifting the data of each dot of the standard printing data Ds one dot at a time towards the right direction. The shifted printing data D1 is the data generated by shifting the data of each dot of the standard printing data Ds one dot at a time towards the left direction.

For example, in a case where there exist data "D1" "D2" . . . "D15" and "D16" from the left end of the line as the data of the line where there is standard printing data Ds, the exposure control section 70 generates the shifted printing data Dr in such a manner that the data of the corresponding line are "0" "D1" . . . "D14" and "D15" from the left end of the line. In this case, the data "D16" serving as the data of the right end of the standard printing data Ds is deleted.

Further, for example, in a case where there exist data "D1" "D2" . . . "D15" and "D16" from the left end of the line as the data of the line where there is standard printing data Ds, the exposure control section 70 generates the shifted printing data D1 in such a manner that the data of the corresponding line are "D2" "D3" . . . "D16" and "0" from the left end of the line. In this case, the data "D1" serving as the data of the left end of the standard printing data Ds is deleted.

In a case where the number of printings of the input printing data is more than one, the exposure control section 70 shifts the printing data for each given unit (for example, for each page set) and executes exposure processing with the exposure section 26. For example, the exposure control section 70 uses the standard printing data Ds, the shifted printing data Dr, and the shifted printing data D1 in order in the exposure processing based on the exposure section 26.

For example, as stated above, it is exemplified that the light emitting section 261 comprises a plurality of light-emitting elements L1, L2 . . . L15 and L16 from the left end, and the exposure section 26 executes exposure processing based on the standard printing data Ds. In this case, the exposure control section 70 sequentially inputs the data "D1"~"D16" to the light-emitting elements L1~L16. That is, the exposure control section 70 inputs the data "D1" to the light-emitting element L1, inputs the data "D2" to the light-emitting element L2, inputs the data "D15" to the light-emitting element L15 and inputs the data "D16" to the light-emitting element L16.

Further, it is exemplified that the exposure section executes exposure processing based on the shifted printing data Dr. In this case, the exposure control section 70 sequentially inputs the data "D1"-"D16" to the light-emitting elements L1-L16. That is, the exposure control section 70 inputs the data "0" to the light-emitting element L1, inputs the data "D1" to the light-emitting element L2, inputs the data "D14" to the light-emitting element L15 and inputs the data "D15" to the light-emitting element L16.

Further, it is exemplified that the exposure section executes exposure processing based on the shifted printing data D1. In this case, the exposure control section 70 sequentially inputs the data "D2"~"D16" and the data "0" to the light-emitting elements L1~L16. That is, the exposure control section 70 inputs the data "D2" to the light-emitting element L1, inputs the data "D3" to the light-emitting element L2, inputs the data "D16" to the light-emitting element L15 and inputs the data "0" to the light-emitting element L16.

For example, when storing the printing data in the register R line by line, the exposure control section 70 shifts the standard printing data to generate shifted printing data Dr and D1. Further, when storing the printing data in the register R line by line, the exposure control section 70 shifts the standard printing data to generate shifted printing data Dr and D1. Further, in a case where the exposure control section 70 comprises a memory such as a RAM memory, the exposure control section 70 may also generate the shifted printing data Dr and D1 on the RAM memory based on the standard printing data.

Figure 5:
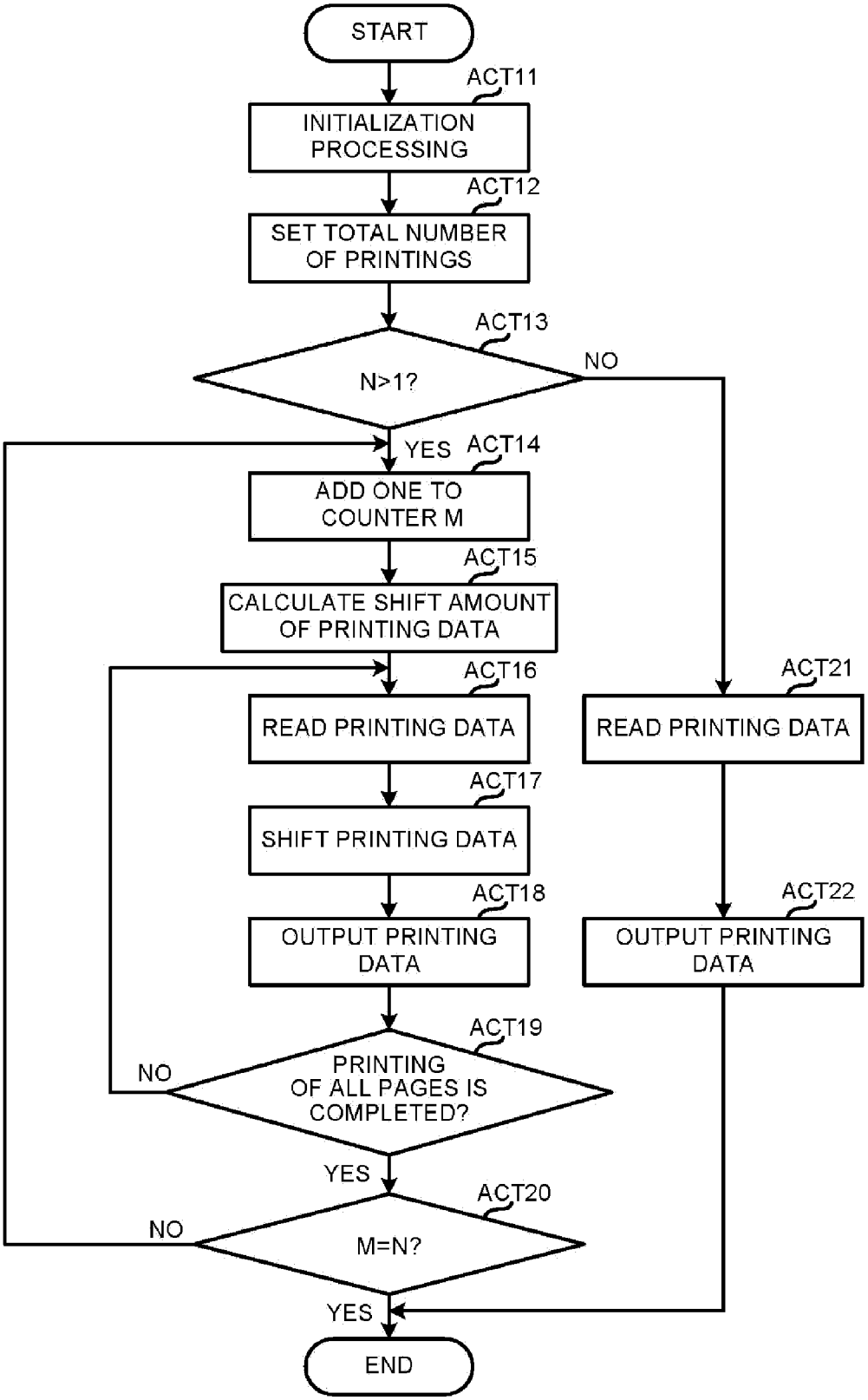
FIG. 5 is a diagram illustrating the operations of the exposure control section of the digital multi-functional peripheral according to the embodiment.

FIG. 5 is a diagram illustrating an example of the operations of the exposure control section 70.

In a case where the printing data is received from the printer CPU 61, the exposure control section 70 starts the exposure processing. In addition, the exposure control section 70 includes a function of counting the number of printings subjected to the exposure processing and a function of setting the number of printings instructed from the printer CPU 61. For example, the exposure control section 70 can be provided with a counter for counting the number of printings subjected to the exposure processing and a memory for storing the number of printings instructed from the printer CPU 61 to realize these functions.

First, the exposure control section 70 carries out an initialization processing (ACT 11). The exposure control section 70 sets the value M of the counter to "0" and sets the value N of the number of printings stored in the memory to "0" through the initialization processing.

As stated above, the information indicating the number of printings is included in the printing data received by the exposure control section 70. The exposure control section 70 recognizes the number of printings from the received printing data and sets the value N of the number of printings in the memory to "N (N=0, 1, 2, 3 . . . )" according to the recognized number of printings (ACT 12).

The exposure control section 70 determines whether or not the value N is greater than "1" (ACT 13). That is, the exposure control section 70 determines whether or not it is necessary to print two or more copies of the same page set.

In a case where it is determined that the value N is greater than "1", the exposure control section 70 adds one to the value M of the counter (ACT 14). Further, the exposure control section 70 calculates the shift amount of the printing data (ACT 15). The shift amount includes the information indicating whether or not to shift the standard printing data Ds, the information indicating whether to shift the standard printing data Ds to the right or the left direction, and the information indicating how many dots the standard printing data Ds should be shifted, and the like.

The exposure control section 70 holds the calculated shift amount in the memory. In addition, it is necessary to make the shift amount of the printing data uniform for the light emitting section 261Y, the light emitting section 261M, the light emitting section 261C and the light emitting section 261K.

The exposure control section 70 is provided with, for example, a memory for holding a table in which the shift amount is associated with the value M of the counter. In a case of calculating the shift amount, the exposure control section 70 first sets the printing data received from the printer CPU 61 as the standard printing data Ds. Further, the exposure control section 70 refers to the table mentioned above according to the value M of the counter, and determines whether or not to shift the standard printing data Ds. Further, in a case of shifting the standard printing data Ds, the exposure control section 70 refers to the table mentioned above according to the value M of the counter, and determines whether to shift the standard printing data Ds to the right or the left direction. Further, the exposure control section 70 refers to the table mentioned above according to the value M of the counter, and determines how many dots the standard printing data Ds should be shifted.

In the example shown in FIG. 4, the table is set in such a manner that in a case where the value of M is "1" (or the remainder of M/3 is "1"), the standard printing data Ds is not shifted; in a case where the value of M is "2" (or the remainder of M/3 is "2"), the standard printing data Ds is shifted for one dot in the right direction; in a case where the value of M is "3" (or the remainder of M/3 is "0"), the standard printing data Ds is shifted for one dot in the left direction. In addition, no limitation is given to the constitution of the table as long as the table is of such a constitution in which the same light-emitting element L is not used in the exposure of a certain dot in the page in a case of carrying out printing of the same page set at least.

The exposure control section 70 reads the printing data for one page of the page set from the image memory (ACT 16). The exposure control section 70 shifts the read printing data (ACT 17). The exposure control section 70 outputs the shifted printing data to the exposure section 26 (ACT 18). In this way, the exposure control section 70 can drive each light-emitting element L of the light emitting section 261 of the exposure section 26.

For example, the exposure control section 70 reads the printing data from the image memory line by line and writes the read printing data for one line in the register R according to the shift amount. The exposure control section 70 outputs the printing data for one line written in the register R to the exposure section 26 and processes the next line of the printing data in the same way. By carrying out such a processing in sequence, the exposure control section 70 can output the printing data for one page to the exposure section 26 in a shifted state.

Further, the exposure control section 70 determines whether or not the printing of all the pages is completed (ACT 19). That is, the exposure control section 70 determines whether or not the exposure processing is completed based on the printing data of all the pages in one page set. In a case where there is a page which is not completed, the exposure control section 70 returns to ACT 16 to repeat the processing. That is, the exposure control section 70 executes the processing from ACT 16 to ACT 19 based on the printing data of all the pages in the page set.

Further, in a case where it is determined that the printing of all the pages is completed in ACT 19, the exposure control section 70 determines whether or not the value M of the counter is equal to the number of printings N (ACT 20). That is, the exposure control section 70 determines whether or not the printing of the page sets corresponding to the number of printings instructed by the printer CPU 61 is completed. In a case where the value M is not equal to the number of printings N, the exposure control section 70 proceeds to the processing in ACT 14. That is, the exposure control section 70 executes the processing from ACT 14 to ACT 20 until the printing of the page sets corresponding to the number of printings instructed by the printer CPU 61 is completed. In this way, the exposure control section 70 can enable the exposure section 26 to execute exposure processing for printing the page sets corresponding to the number of printings instructed by the printer CPU 61. Further, in a case where the value M is equal to the number of printings N in ACT 20, the exposure control section 70 ends the processing.

Further, in a case where it is determined that the value N is not greater than "1" in ACT 13, the exposure control section 70 enables the exposure section 26 to execute exposure processing without shifting the printing data. That is, the exposure control section 70 reads the printing data form the image memory (ACT 21), and outputs the printing data to the exposure section 26 without shifting the read printing data (ACT 22).

As stated above, the exposure control section 70 can carry a control so as not to shift the printing data in a case where the number of printings is one and to shift the printing data in a case where the number of printings is two or more. In this way, the exposure control section 70 can control the exposure section 26 so that the light-emission frequency of the plurality of light-emitting elements of the light emitting section 261 of the exposure section 26 is not biased even in a case where the number of printings is more than one. In this way, the exposure control section 70 can extend the life of the plurality of light-emitting elements of the light emitting section 261 of the exposure section 26. As a result, an image forming apparatus with a long life and a control method of the image forming apparatus can be provided.

In addition, though the light-emitting elements L of the light emitting section 261 are described as, for example, the light-emitting elements L1, L2 . . . L15 and L16 in the embodiment described above, the present invention is not limited to this. No limitation is given to the number of the light-emitting elements L of the light emitting section 261 which are arranged in a line. For example, the more the number of the light-emitting elements L in a line is, the higher the printing precision is. Thus, the more the number of the light-emitting elements L in a line is, the more the shift of the printing result in a case where the printing data is shifted is reduced. That is, even in a case where the printing data is shifted and printed for each page set as stated above, the apparent difference of the printing result is reduced as long as the density of the light-emitting elements L in a line is high enough. For example, it is preferred to set the density of the light-emitting elements L in a line to be a certain density so that the change of the printing position on the paper sheet 7 caused by the shift is smaller than the conveyance shift in a case where the paper sheet 7 is conveyed to the transfer section 28. In this case, the difference of the printing result due to the shift of the printing data stated above can be ignored.

Further, in the embodiment described above, it is exemplified that in a case where the number of printings based on the same printing data is more than one, the exposure control section 70 shifts the printing data for each page set of the printing data; however, the present invention is not limited to this. The exposure control section 70 may also shift the printing data for each page of the page sets of the printing data. In this case, the exposure control section 70 counts the value M of the counter according to the number of printed pages. In accordance with such a constitution, the exposure control section 70 can prevent that the same light-emitting element L is made to emit light continuously even in a case where the pages on which there is a pattern of routine are continuous.

In addition, the function described in the embodiment is not limited to be constituted using hardware, and the function may be realized by reading the program in which each function is recorded into a computer using software. Further, each function may be selectively constituted by a proper software or hardware.

In the embodiment described above, it is exemplified that the function for implementing the present invention is prerecorded in the apparatus. However, the present invention is not limited to this, same function may be downloaded to the apparatus from a network. Alternatively, same function recorded in a recording medium may be also installed in the apparatus. The form of the recording medium is not limited as long as the recording medium can store programs like a CD-ROM and the like and is readable by an apparatus. Further, the function realized by an installed or downloaded program can also be realized through the cooperation with an OS (Operating System) installed in the apparatus.

While certain embodiments have, been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a plurality of light-emitting elements arranged in a line;

an image forming section configured to develop, with a developing agent, a latent image formed on a photoconductive drum through light from the plurality of light-emitting elements which emit light according to printing data; and an exposure control section configured to control operations of the plurality of light-emitting elements according to shifted printing data obtained by shifting the printing data when printing a page set with the same printing data more than once.

2. The image forming apparatus according to claim 1, wherein the exposure control section generates the printing data for each given unit.

3. The image forming apparatus according to claim 2, wherein the exposure control section shifts the printing data for each page set including a plurality of pages in the printing data.

4. The image forming apparatus according to claim 2, wherein the exposure control section shifts the printing data for each page of the printing data.

5. The image forming apparatus according to claim 1, wherein the shifted printing data is generated by shifting the data of dots of the printing data a given number of dots at a time.

6. A control method of an image forming apparatus, including:

controlling the operations of a plurality of light-emitting elements according to shifted printing data obtained by shifting the printing data when printing a page set with the same printing data more than once.

* * * * *